United States Patent [19]

Allen et al.

[11] 4,342,543

[45] Aug. 3, 1982

[54] OIL LEVEL CONTROL

[75] Inventors: Karl D. Allen, Canton; Mark A. Perlick, Brighton; Jack H. Van Gorder, Chelsea, all of Mich.

[73] Assignee: General Motors Corporation, Detroit, Mich.

[21] Appl. No.: 175,315

[22] Filed: Aug. 4, 1980

[51] Int. Cl.[3] ..... F04B 49/00

[52] U.S. Cl. ..... 417/211.5; 91/52; 91/230; 91/325; 417/401

[58] Field of Search ..... 91/52, 325, 243, 230, 91/231; 417/211.5, 401, 392, 402

[56] References Cited

U.S. PATENT DOCUMENTS

| | | | |
|---|---|---|---|
| 805,633 | 11/1905 | Clement | 91/230 |
| 838,451 | 12/1906 | Reeve | 417/211.5 X |
| 2,789,510 | 4/1957 | Meynig | 417/402 |
| 3,520,477 | 7/1970 | Cooley | 417/401 X |
| 3,646,849 | 3/1972 | Smith | 91/52 |

*Primary Examiner*—Carlton R. Croyle
*Assistant Examiner*—Edward Look
*Attorney, Agent, or Firm*—Donald F. Scherer

[57] ABSTRACT

An oil level control system uses an available pressure source to operate a fluid motor which is integrally connected with a reciprocating fluid pump. The pump has an inlet passage disposed at the desired oil level in a primary reservoir. A pair of one-way valves cooperate with the pump to draw oil, above the desired level, from the primary reservoir and deliver the oil to a secondary reservoir. A restricted drain back passage permits the fluid to return to the primary reservoir to ensure that the desired level is maintained. The fluid motor is connected with an accumulator such that the initial portion of the stroke is operated by the pressure source of the pump stroke. The motor is driven by pressurized fluid in the accumulator.

4 Claims, 2 Drawing Figures

OIL LEVEL CONTROL

This invention relates to oil level controls and more particularly to oil level controls having positive displacement pump means for enforcing maintenance of a desired oil level in a primary reservoir.

It is an object of this invention to provide an improved oil level control wherein a reciprocating pump is operative to move the fluid, above a predetermined level, from a primary reservoir to a secondary reservoir.

It is another object of this invention to provide an improved oil level control wherein a positive displacement reciprocating pump is operative to move oil from a primary reservoir to a secondary reservoir so as to maintain a predetermined level in the primary reservoir and wherein a fluid motor has an annular chamber selectively pressurized by a continuous oil pressure source to initiate the pump stroke, and a cylindrical chamber selectively pressurized by a stored source of pressurized oil to continue the pump stroke.

It is a further object of this invention to provide an improved oil level control wherein a reciprocating pump is driven by a fluid motor which has an annular chamber, selectively responsive to a continuous oil pressure source during a portion of the pump stroke, and a cylindrical chamber selectively responsive to a stored pressure source during the remainder of the pump stroke, and wherein the cylindrical chamber has a cross-sectional area greater than the cross-sectional area of the annular chamber.

These and other objects and advantages of the present invention will be more apparent from the following description and drawings in which.

Figure 1:
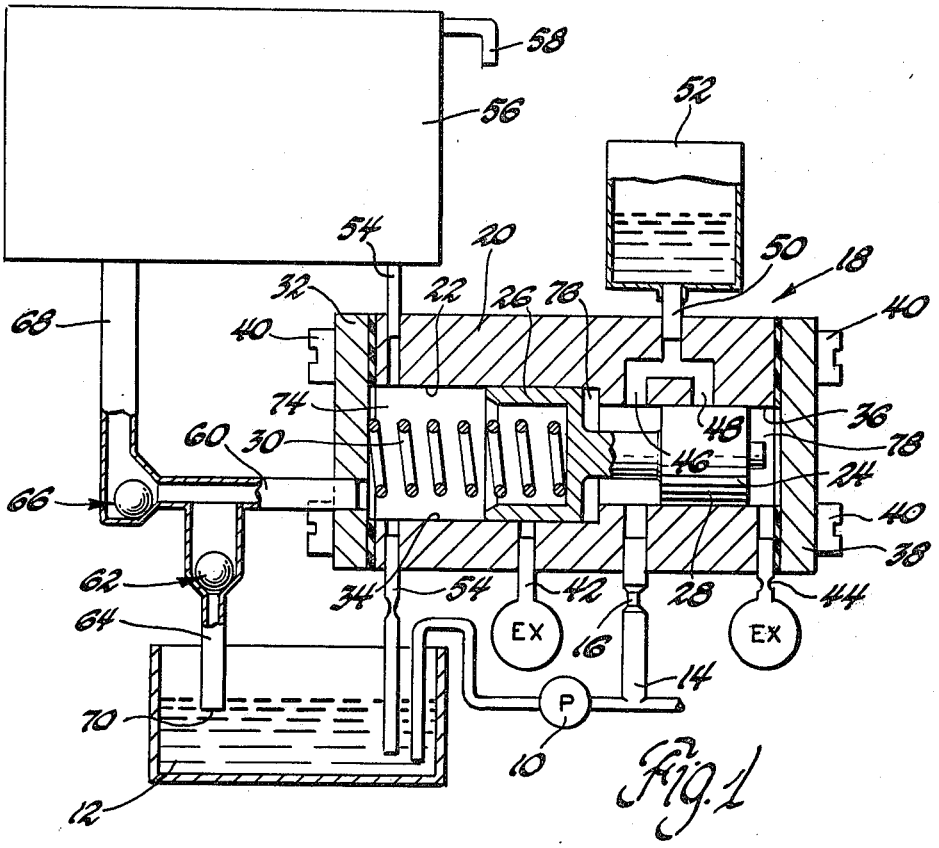
FIG. 1 is a diagrammatic representation of an oil level control system.

Referring to the drawings, wherein like characters represent the same or corresponding parts, there is seen in FIG. 1, a control system having a pump 10, which draws fluid from a primary reservoir 12 and delivers pressurized fluid to a passage 14. The pump 10 is preferably a positive displacement pump, such as a sliding vane type or meshing gear type. The reservoir 12 can be the bottom pan of a conventional automatic transmission.

Devices such as pump 10 and reservoir 12, are well-known in the art. The passage 14 is adapted to be connected to a conventional transmission control, not shown, and also, through a restriction 16, to a pump motor unit, generally designated 18. The unit 18 includes a housing 20 which has formed therein, a stepped bore 22, a sliding plunger member 24 having a large diameter portion 26 and a small diameter portion 28, and a spring member 30 which is compressed between an end cover 32 and the plunger member 24. The stepped bore 22 has a large diameter portion 34, in which diameter 26 of plunger 24 is slidably disposed, and a small diameter portion 36, in which diameter 28 is slidably disposed. The small diameter 36 is closed by an end cap 38. Both end caps 38 and 32 are held in place by a plurality of fasteners, such as 40.

The large diameter portion 34 is connected to an exhaust passage 42. The small diameter portion 36 is connected to the passage 14 downstream of the restriction 16, to a restricted exhaust passage 44, through two ports 46 and 48, to an accumulator passage 50. The accumulator passage 50 is connected to an air over oil accumulator 52, which is of conventional and well-known design. The large diameter portion 34 is also connected to a restricted drain back passage 54 which is connected between the primary reservoir 12 and secondary reservoir 56. The secondary reservoir 56 is a conventional reservoir and may be, if used with an automatic transmission, either external to the transmission housing or formed within the transmission housing. The secondary reservoir 56 has a vent passage 58 which permits atmospheric pressure to be operable therein and will also permit oil to be exhausted therefrom if overfilling of the secondary reservoir 56 should occur.

The end cap 32 has connected thereto a passage 60 which is in fluid communication with the large diameter portion 34. The passage 60 is also connected through a one-way ball check valve 62 with a passage 64 and through a one-way ball check valve 66 to a passage 68. The passage 64 terminates in the primary reservoir 12 at end 70 which is coincident with the desired oil level in the reservoir 12. The passage 68 is in fluid communication with the secondary reservoir 56.

The large diameter 26 of plunger 24 cooperates with the large diameter portion 34 to form a cylindrical pumping chamber 74 and an annular motor chamber 76. The small diameter 28 of plunger 24 cooperates with the small diameter portion 36 to form a cylindrical motor chamber 78. The chambers 74, 76 and 78 are expansible and contractible when the plunger 24 is reciprocated within the stepped bore 22. The effective cross-sectional area of chamber 76 is preferably equal to one-half the cross-sectional area of cylindrical chamber 78. The sum of the effective cross-sectional areas of chambers 76 and 78 is preferably equal to the cross-sectional area of chamber 74.

As seen in FIG. 1, when the plunger 24 is extended to the right by spring 30, the exhaust passage 42 is blocked by diameter 26, the pressurized passage 14 is in communication with the annular chamber 76 and with the accumulator passage 50 through port 46, port 48 blocked by the small diameter 28 and restricted passage 44 is in communication with cylindrical chamber 78. The fluid pressure delivered by pump 10 will pass through the restriction 16 and proceed to increase the pressure in the accumulator 52 and annular chamber 76. When the pressure in accumulator 52 is at a level sufficient so that the pressure in chamber 76 will overcome the force of spring 30, the plunger 24 will begin to move to the left. Leftward movement of the plunger 24 will cause the chamber 74 to contract such that fluid contained therein will be forced into passage 60 resulting in the closing of check valve 62 and the opening of check valve 66. The opening of check valve 66 permits the fluid in passage 60 to be delivered through passage 68 to the secondary reservoir 56.

Figure 2:
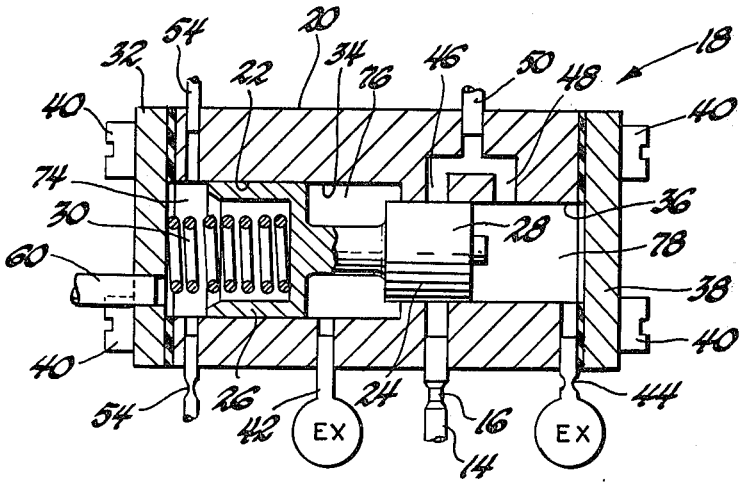
FIG. 2 is a diagrammatic view of a portion of FIG. 1 showing another operative position.

After the plunger 24 has proceeded leftward, the small diameter 28 will open port 48 and then close passage 14, and therefore connect accumulator 52, to chamber 78. The fluid pressure in accumulator 52 will then operate on the larger cross-sectional area of chamber 78 to enforce continued leftward movement of plunger 24. Subsequent to the opening of port 48 and closing of passage 14, additional travel of plunger 24 will permit the large diameter 26 to open exhaust passage 42 such that the fluid pressure operating on annular chamber 76 will be relieved. Pressurized fluid in accumulator 52 will pass through chamber 78 and the restricted exhaust passage 44. Due to the restriction in exhaust passage 44, the pressure decay will occur over a period of time. Since the cross-sectional area of chamber 78 is preferably twice that of chamber 76, the plunger will continue to move leftward until the fluid pressure in accumulator 52 is reduced to one-half of its original value. The pressure decay ratio of accumulator 52 can be changed and will, of course, be determined by the area ratio of chamber 76 and 78. The plunger 24 will ultimately come to the position shown in FIG. 2, which is the leftward end of the motor pump stroke and the pressure in chamber 78 will be reduced sufficiently to permit the spring 30 to return the plunger 24 to the right. During movement to the right, the port 48 will be closed while passage 14 and port 46 will simultaneously open. Upon the opening of passage 14 and opening 46, fluid pressure will begin to develop in the annular chamber 76 and in the accumulator 52. However, due to the restriction 16, the pressure increase will be delayed such that sufficient pressure in annular chamber 76 will not be immediately available to cause the motor to stroke plunger 24 leftward. The delay time caused by the size of restriction 16 is designed to permit the plunger 24 to completely return to the rightward position shown in FIG. 1 prior to the pressure being sufficient to overcome spring 30.

During movement of the plunger 24 to the right, oil in primary reservoir 12, if it is above the end 70, will be drawn into chamber 74 through passage 64 and past check valve 62. During the expansion of chamber 74, the fluid head of secondary reservoir 56 will cause check valve 66 to close. Eventually pressure in annular chamber 76 will increase to its operable level causing the plunger 24 to begin its leftward stroke and thus another pumping cycle will begin. The fluid in primary reservoir 12 will be moved to the secondary reservoir 56 as long as the end 70 is covered by fluid. If the end 70 is at or above the fluid level in primary reservoir 12, pumping action will not occur.

The drain back passage 54 is available to permit the oil in secondary reservoir 56 to return slowly to the primary reservoir 12, thus ensuring that the oil level therein will be at or above the desired level during initial operation. This will accommodate the contraction of the oil due to cooling should the system be inoperative for an extended period of time. The oil level in primary reservoir 12 is, of course, important since the inlet to pump 10 must always be beneath the oil level to prevent cavitation.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. An oil level control for a fluid pressure system having a fluid pump pressure source, a primary reservoir and a secondary reservoir; said level control comprising; a reciprocating fluid pump having intake and discharge strokes; passage means for interconnecting said reciprocating fluid pump with the primary and secondary reservoirs, said passage means extending into the primary reservoir and including an opening at the fluid level desired to be maintained in the primary reservoir; valve means in said passage means for simultaneously permitting fluid flow from the primary reservoir and preventing fluid flow from the secondary reservoir during the intake stroke of the reciprocating fluid pump, said valve means also simultaneously permitting fluid flow to the secondary reservoir and preventing fluid flow to the primary reservoir during the discharge stroke of the reciprocating fluid pump; fluid motor means formed integrally with said reciprocating pump means and including an annular expansible chamber selectively connected to the fluid pump pressure source to enforce movement of the reciprocating pump during the initial portion of the discharge stroke thereof, and a cylindrical expansible chamber adapted to be pressurized to enforce movement of the reciprocating fluid pump during a secondary portion of the discharge stroke; a fluid pressure accumulator selectively and sequentially connected with said annular chamber and said cylindrical chamber and being pressurized by said fluid pump pressure source when the annular chamber is pressurized; restricted exhaust passage means in fluid communication with said cylindrical chamber for providing controlled exhausting of the fluid pressure in said pressure accumulator through said cylindrical chamber during the secondary portion of the discharge stroke; and spring means operatively connected with said reciprocating fluid pump for enforcing the intake stroke thereof.

2. An oil level control for a fluid pressure system having a fluid pump pressure source, a primary reservoir and a secondary reservoir; said level control comprising; a reciprocating fluid pump having intake and discharge strokes; passage means for interconnecting said reciprocating fluid pump with the primary and secondary reservoirs, said passage means extending into the primary reservoir and including an opening at the fluid level desired to be maintained in the primary reservoir; valve means in said passage means for simultaneously permitting fluid flow from the primary reservoir and preventing fluid flow from the secondary reservoir during the intake stroke of the reciprocating fluid pump, said valve means also simultaneously permitting fluid flow to the secondary reservoir and preventing fluid flow to the primary reservoir during the discharge stroke of the reciprocating fluid pump; fluid motor means formed integrally with said reciprocating pump means and including an annular expansible chamber selectively connected to the fluid pump pressure source to enforce movement of the reciprocating pump during the initial portion of the discharge stroke thereof, and a cylindrical expansible chamber adapted to be pressurized to enforce movement of the reciprocating fluid pump during a secondary portion of the discharge stroke; a fluid pressure accumulator selectively and sequentially connected with said annular chamber and said cylindrical chamber and being pressurized by said fluid pump pressure source when the annular chamber is pressurized; restricted exhaust passage means in fluid communication with said cylindrical chamber for providing controlled exhausting of the fluid pressure in said pressure accumulator through said cylindrical chamber during the secondary portion of the discharge stroke; spring means operatively connected with said reciprocating fluid pump for enforcing the intake stroke thereof; and a restricted return passage means for providing continuous restricted fluid communication from the secondary reservoir to the primary reservoir.

3. An oil level control for a fluid pressure system having a fluid pump pressure source, a primary reservoir and a secondary reservoir; said level control comprising; a reciprocating fluid pump including an expansible cylindrical pump volume operable to provide intake and discharge strokes; passage means for interconnecting said reciprocating fluid pump with the primary and secondary reservoirs, said passage means extending into the primary reservoir and including an opening at the fluid level desired to be maintained in the primary reservoir; valve means in said passage means for simultaneously permitting fluid flow from the primary reservoir and preventing fluid flow from the secondary reservoir during the intake stroke of the reciprocating fluid pump, said valve means also simultaneously permitting fluid flow to the secondary reservoir and preventing fluid flow to the primary reservoir during the discharge stroke of the reciprocating fluid pump; fluid motor means formed integrally with said reciprocating pump means and including an annular expansible volume of lesser cross-sectional area than the area of the cylindrical pump volume and being selectively connected to the fluid pump pressure source to enforce movement of the reciprocating pump during the initial portion of the discharge stroke thereof, and a cylindrical expansible motor volume of greater cross-sectional area than the area of said annular volume and lesser area than the area of the cylindrical pump volume and being adapted to be pressurized to enforce movement of the reciprocating fluid pump during a secondary portion of the discharge stroke; a fluid accumulator selectively and sequentially connected with said annular volume and said cylindrical motor volume and being pressurized by said fluid pump pressure source when the annular volume is pressurized, restricted exhaust passage means in fluid communication with said cylindrical motor volume for providing controlled exhausting of the fluid pressure in said pressure accumulator through said cylindrical motor volume during the secondary portion of the discharge stroke; spring means operatively connected with said reciprocating fluid pump for enforcing the intake stroke thereof; and a restricted return passage means for providing continuous restricted fluid communication from the secondary reservoir to the primary reservoir.

4. An oil level control for a fluid pressure system having a fluid pump pressure source, a primary reservoir and a secondary reservoir; said level control comprising; a reciprocating fluid pump having intake and discharge strokes; passage means for interconnecting said reciprocating fluid pump with the primary and secondary reservoirs, said passage means extending into the primary reservoir and including an opening at the fluid level desired to be maintained in the primary reservoir; valve means in said passage means for simultaneously permitting fluid flow from the primary reservoir and preventing fluid flow from the secondary reservoir during the intake stroke of the reciprocating fluid pump, said valve means also simultaneously permitting fluid flow to the secondary reservoir and preventing fluid flow to the primary reservoir during the discharge stroke of the reciprocating fluid pump; pressure accumulator means selectively connectable with said fluid pump pressure source; fluid motor means formed integrally with said reciprocating pump means and including an annular expansible chamber selectively connected to the fluid pump pressure source to enforce movement of the reciprocating pump during the initial portion of the discharge stroke thereof, and a cylindrical expansible chamber selectively pressurized by said pressure accumulator to enforce movement of the reciprocating fluid pump during a secondary portion of the discharge stroke; restricted exhaust passage means in fluid communication with said cylindrical chamber for providing controlled exhausting of the fluid pressure in said pressure accumulator through said cylindrical chamber during the secondary portion of the discharge stroke; spring means operatively connected with said reciprocating fluid pump for enforcing the intake stroke thereof; means on said fluid motor means for simultaneously connecting said annular expansible chamber and said pressure accumulator with said fluid pump pressure source and for closing said pressure accumulator means and said annular chamber from said fluid pump pressure source while opening said cylindrical chamber to said pressure accumulator means.

* * * * *